United States Patent [19]

Esposito

[11] Patent Number: 4,726,498

[45] Date of Patent: Feb. 23, 1988

[54] AUTOLOCK KNIFE HOLSTER

[76] Inventor: Robert Esposito, 57 Amber St., Staten Island, N.Y. 10306

[21] Appl. No.: 906,263

[22] Filed: Sep. 8, 1986

[51] Int. Cl.[4] ..... B26B 29/02

[52] U.S. Cl. ..... 224/232; 30/151

[58] Field of Search ..... 224/232; 30/151; D22/118

[56] References Cited

U.S. PATENT DOCUMENTS 3,958,330 5/1976 Hutchens ..... 224/232 X

*Primary Examiner*—Henry J. Recla

*Assistant Examiner*—David Voorhees

*Attorney, Agent, or Firm*—Richard L. Miller

[57] ABSTRACT

An auto lock knife holster designed to releasably lock all fixed blade type hunting knifes having guards into a sheath so as to prevent against inadvertent dislodging and loss of the knife.

4 Claims, 5 Drawing Figures

AUTOLOCK KNIFE HOLSTER

BACKGROUND OF THE INVENTION

The instant invention relates generally to securing devices and more particularly it relates to a knife sheath and lock for securing a knife having a guard within a scabbard to prevent against inadvertent dislodging and loss of the knife.

While there are many conventional sheaths such as those described in U.S. Pat. Nos. 2,527,710; 4,404,747 and 4,414,744 none of these conventional sheaths are as suitable for holding and protecting and securing a knife therein as the instant invention herein disclosed.

SUMMARY OF THE INVENTION

A primary object of the present invention is to provide a knife sheath and lock that will overcome the shortcomings of the prior art devices.

Another object is to provide a knife sheath for releasably securing a knife therein.

An additional object is to provide a knife sheath that automatically locks the knife in the sheath so as to prevent accidental loss of the knife.

A further object is to provide a sheath that has minimal mechanical components which are simple in design and inexpensive to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
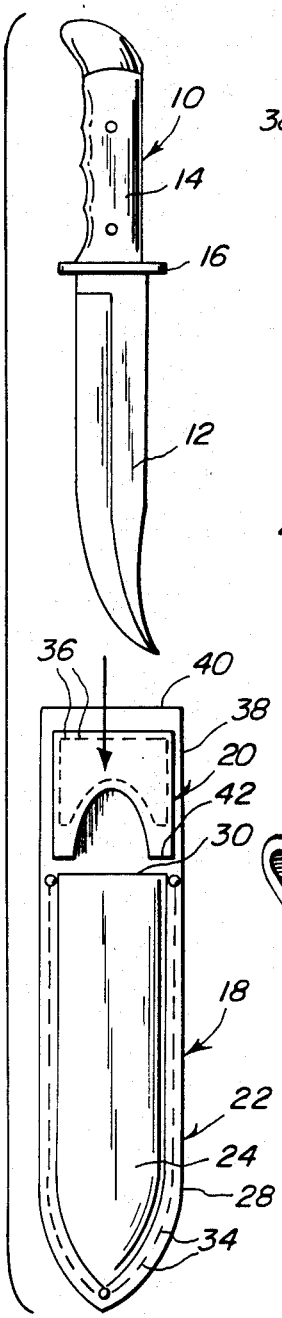
FIG. 1 is a front view of the invention with a knife about to be inserted therein.

Turning now descriptively to the drawings, in which like reference characters denote like elements throughout the several views, FIGS. 1 through 5 illustrate a knife 10 comprising a blade 12, having a handle 14 and a guard 16, and a sheath 18 with arch shaped component 20 adapted to secure the knife 10 inside said sheath 18.

In the form of the invention illustrated in FIGS. 1 through 5, the sheath 18 comprises one piece of material 22 such as cowhide, rubber, plastic, etc., which is folded in half at 40 forming the front 24 and back 26. Front 24 is sewn with stitching 34 to back 26 at the majority of its circumferential edge 28.

In FIG. 1 is seen how knife 10 can be inserted into sheath 18 through a slit 30 on the front 24. When the blade 12 is inserted into slit 30 of sheath 18 and knife 10 is pushed all the way into sheath 18, the guard 16 will pass the lower edge 42 of arch shaped component 20, preventing the accidental removal of the knife from the sheath.

When it is desired to remove the knife 10 from sheath 18 the lower edge 42 of arch shaped member 20 is pressed toward the belt loop 38 in the direction of arrow 44 while the knife 10 is withdrawn in the direction of arrow 46.

Arch shaped member 20 is sewn by stitching 36 to front 24 at its upper end on belt loop of sheath 18.

Figure 2:
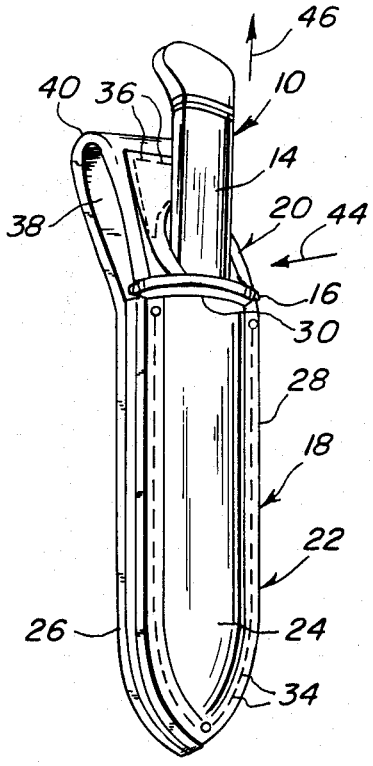
FIG. 2 is a perspective view with the knife in place within the holster or sheath.
Figure 3:
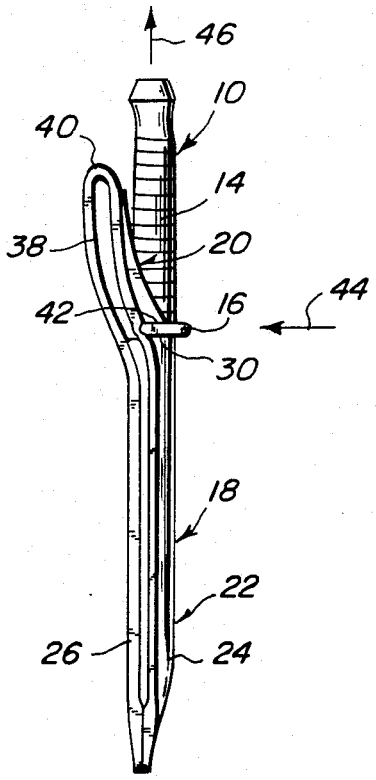
FIG. 3 is a side view thereof.

FIGS. 2 and 3 show the knife 10 inserted into sheath 18 and locked into place using arch shaped member 20.

Figure 4:
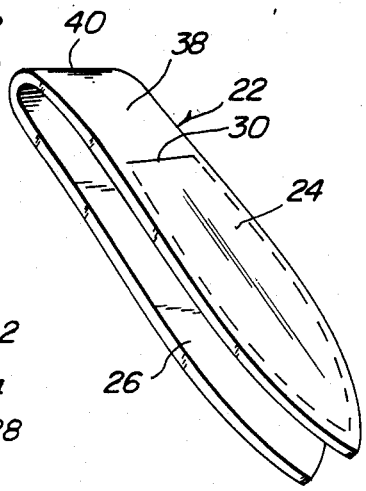
FIG. 4 is a perspective view showing how the holster is fabricated.

FIG. 4 shows how the sheath 18 is made from one piece of material 22 which is folded over forming front 24 and back 26. Slit 30 through which knife 10 and guard 16 are pushed into is also seen.

Figure 5:
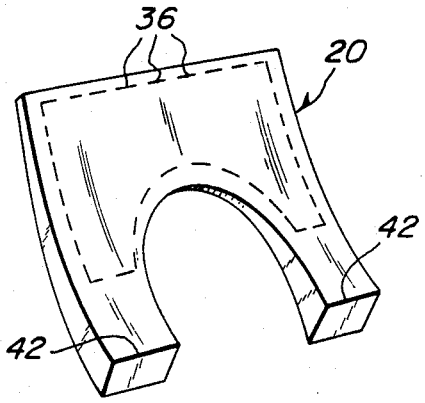
FIG. 5 is an enlarged view of the locking member.

FIG. 5 shows the arch shaped member 20 more clearly. The bottom portion of handle 14 of knife 10 fits snugly below the lower edge 42 of said arch shaped member 20.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An auto lock knife holster comprising:
   (a) a knife having a handle, a blade and a peripheral outwardly projecting flange defining a guard between the handle and blade;
   (b) a sheath with means for encasing said knife inside therein; and
   (c) means for locking said knife inside said sheath, comprising an inverted U-shaped arch shaped member attached to said sheath outside of and above said means for encasing for encircling said handle, said member gradually outwardly projecting forwardly from the surface of the sheath from the top of the member on its bottom whereby the bottom of said arch shaped means projects outwardly from the surface to define a ledge which automatically engages said guard of said knife when said blade of said knife is inserted all the way into said sheath and requiring depression of said member to release the guard, whereby said knife is locked into said holster and cannot inadvertently fall out of said sheath nor accidentally be removed from said sheath.

2. An autolock knife holster as recited in claim 1, wherein said sheath is fabricated of one piece of material.

3. An auto lock knife holster as recited in claim 2, wherein said material is folded over to form a front and back and is sewn together at the majority of its circumferential edge.

4. An auto lock knife holster as recited in claim 3, wherein said front has a slit cut through said front of said sheath for the insertion of a blade of said knife.

* * * * *